US009854352B2

(12) United States Patent
Huang

(10) Patent No.: US 9,854,352 B2
(45) Date of Patent: Dec. 26, 2017

(54) ACOUSTIC TUNABLE SPEAKER DEVICE

(71) Applicant: Chiun Mai Communication Systems, Inc., New Taipei (TW)

(72) Inventor: Po-Sen Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/099,630

(22) Filed: Apr. 15, 2016

(65) Prior Publication Data

US 2017/0156004 A1 Jun. 1, 2017

(30) Foreign Application Priority Data

Nov. 30, 2015 (CN) ..... 2015 1 0858032

(51) Int. Cl.
*H04R 1/02* (2006.01)
*H04R 1/28* (2006.01)
*H04R 1/34* (2006.01)

(52) U.S. Cl.
CPC ..... *H04R 1/2896* (2013.01); *H04R 1/34* (2013.01); *H04R 2201/025* (2013.01)

(58) Field of Classification Search
CPC .. H04R 1/2811; H04R 1/1075; H04R 1/1008; H04R 1/288
USPC ..... 381/370–375
See application file for complete search history.

(56) References Cited

U.S. PATENT DOCUMENTS 5,729,605 A * 3/1998 Bobisuthi ..... H04R 1/225 379/430
2009/0232340 A1* 9/2009 Yang ..... H04R 1/2811 381/371

* cited by examiner

*Primary Examiner* — Sunita Joshi
(74) *Attorney, Agent, or Firm* — ScienBiziP, P.C.

(57) ABSTRACT

A speaker device with an acoustic tuning assembly can adjust sound in variety. The acoustic tuning assembly includes a main body and a housing receiving the main body. The main body receives an acoustic unit, and includes a first sound chamber and an upper peripheral wall. The housing defines a plurality of through holes. The upper peripheral wall defines a plurality of match holes. The housing can be rotated relatively to the main body to make the through holes of the housing overlapped partially or completely with the match holes to form a plurality of overlap holes, or make the through holes of the housing non-overlapping with the match holes. Therefore, sound from the acoustic unit can be transmitted through the first sound chamber and selectively through the overlap holes.

18 Claims, 4 Drawing Sheets

ACOUSTIC TUNABLE SPEAKER DEVICE

FIELD

The subject matter herein generally relates to speaker devices, and particularly to an acoustic tunable speaker device.

BACKGROUND

Earphones are commonly used with a variety of electronic devices to provide mobile and/or personal access to audio content. For example, earphones can be used with music players, such as MP3, and CD players. Earphones can also be used with cellular phones, personal digital assistants, computers, and most other types of electronic devices that produce audio signals.

BRIEF DESCRIPTION OF THE DRAWINGS

Implementations of the present technology will now be described, by way of example only, with reference to the attached figures.

DETAILED DESCRIPTION

Figure 1:
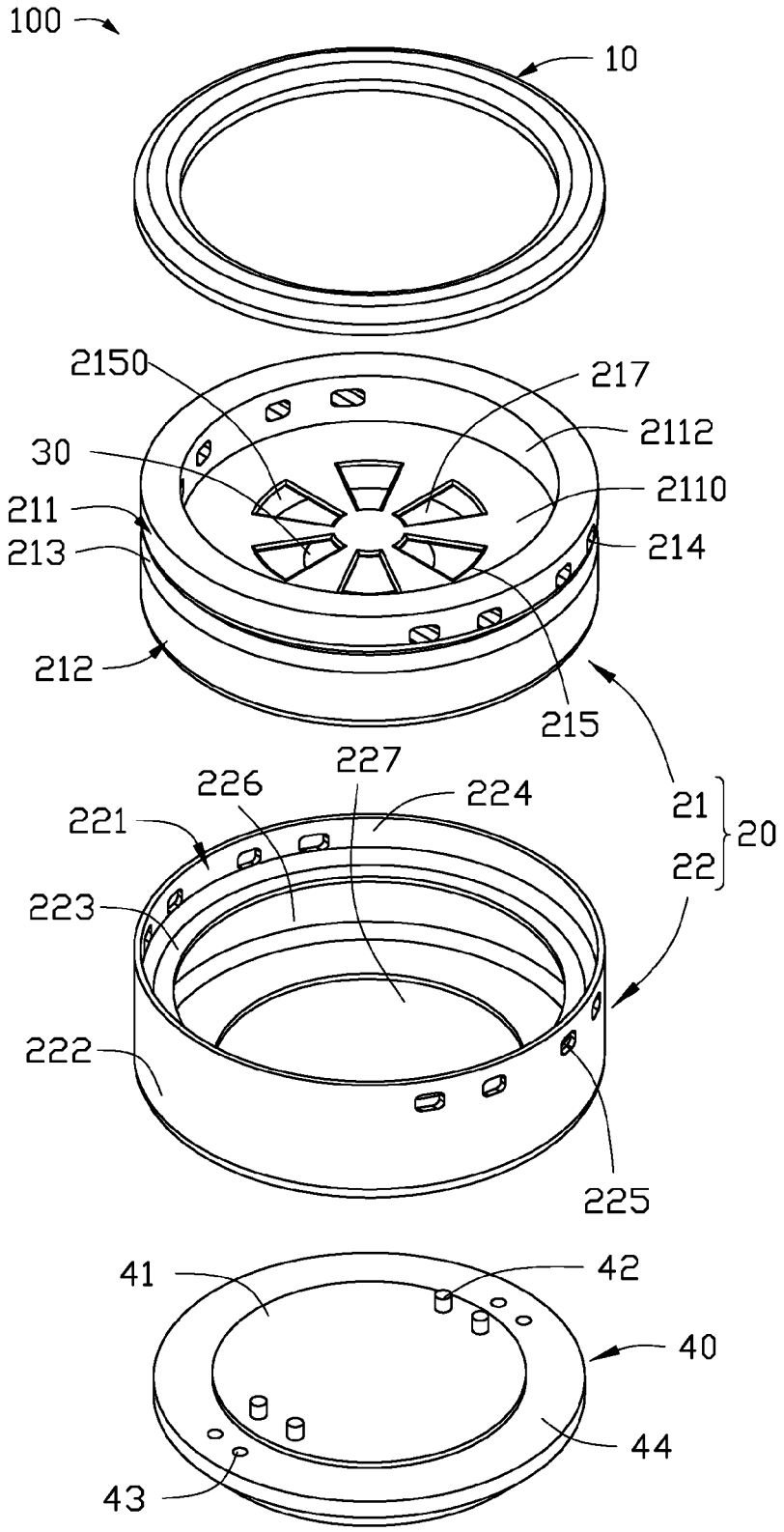
FIG. 1 is an exploded view of a speaker device according to one embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series and the like.

The disclosure is described in relation to an acoustic tunable speaker device.

Figure 2:
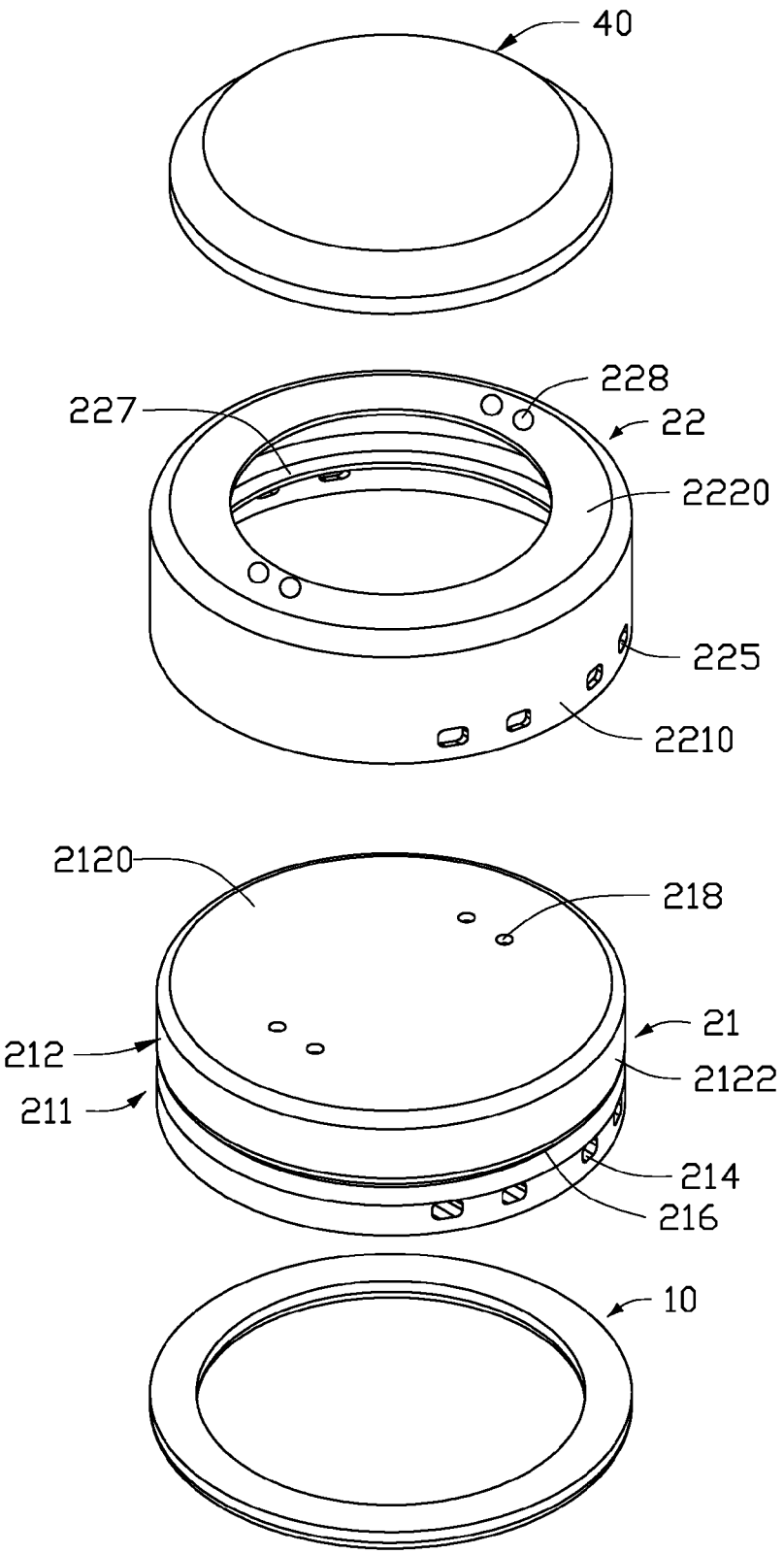
FIG. 2 is an exploded view of the speaker device from another angle shown in FIG. 1.

FIGS. 1 and 2 illustrate isometric views of one embodiment of a speaker device 100 from two angles respectively. The speaker device 100 can include a cover 10, an acoustic tuning assembly 20, an acoustic unit 30, and a base unit 40. The acoustic tuning assembly 20 can include a main body 21 and a housing 22 configured to receive the main body 21.

The main body 21 can be a shape of cylinder and includes a first body 211, a second body 212, and a groove 213. The groove 213 is formed between the first body 211 and the second body 212, and the groove 213 is around a periphery of the main body 21. The first body 211 includes a bottom surface 2110 and an upper peripheral wall 2112 extending from an edge of the bottom surface 2110. An opening is defined on one side of the circular away from the bottom surface 2110. A plurality of match holes 214 are defined on the upper peripheral wall 2112 according to a preset arrangement mode. In at least one embodiment, the match holes 214 number eight, four of them are arranged in a first side of the upper peripheral wall 2112, and four of them are arranged in a second side opposite to the first side of the upper peripheral wall 2112. The bottom surface 2110 of the first body 211 defines a plurality of acoustic holes 215 encircling a center point of the bottom surface 2110. In at least one embodiment, the acoustic holes 215 number six and have a shape of a sector. Each of the acoustic holes 215 includes a side wall 2150 extending from the bottom surface 2110 and away from the first body 211.

Figure 3:
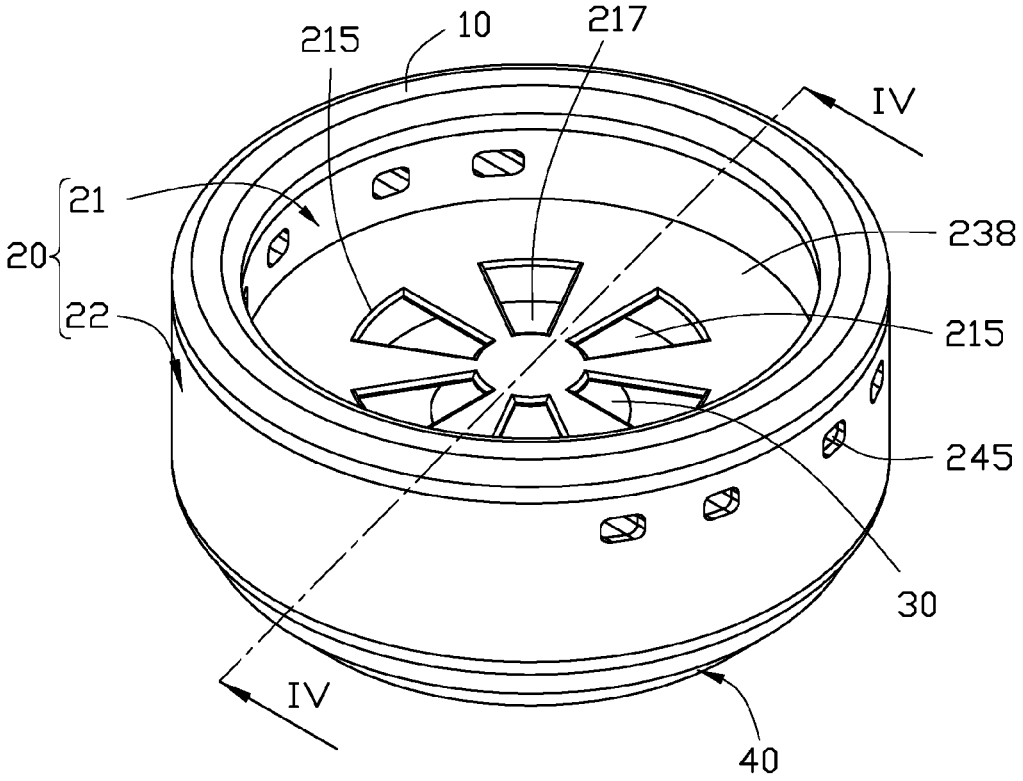
FIG. 3 is an assembled view of the speaker device shown in FIG. 1.
Figure 4:
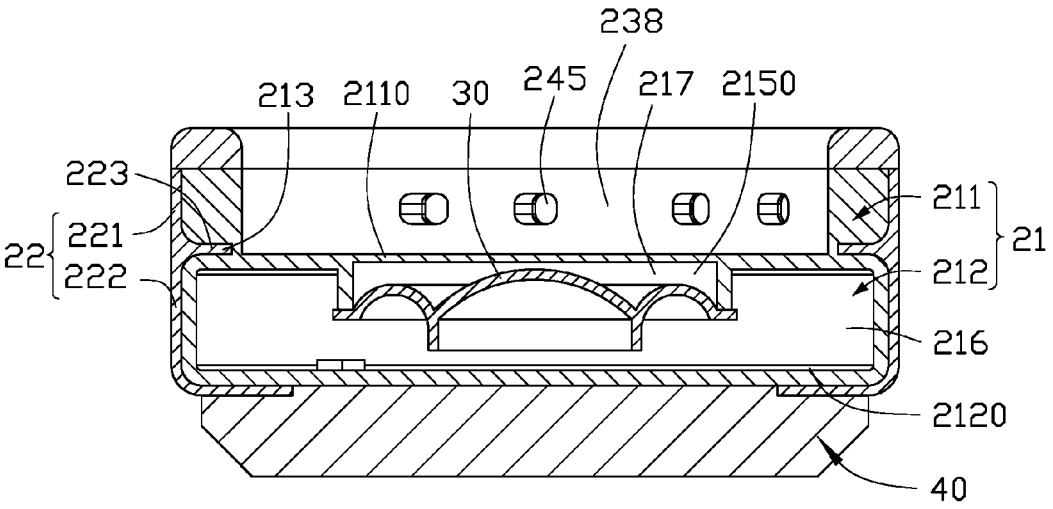
FIG. 4 is a sectional view of the speaker device as shown in FIG. 3 along line IV-IV.

Referring to FIGS. 3 and 4, the second body 212 includes a lower surface 2120 and a lower circular wall 2122 extending from an edge of the lower surface 2120. The second body 212 of the main body 21 defines a receiving space 216 formed of the lower surface 2120, the lower circular wall 2122, and bottom surface 2110, for receiving the acoustic unit 30. The acoustic unit 30 is coupled to the side wall 2150, and forms a first sound chamber 217 with the bottom surface 2110. The first sound chamber 217 can be a shape of tubular. The lower surface 2120 of the second body 212 defines a plurality of position holes 218. In at least one embodiment, the position holes 218 number four, two of them are arranged in a first side of the lower surface 2120 of the second body 212, and two of them are arranged in a second side of the lower surface 2120 of the second body 212. A second sound chamber 238 is formed between the bottom surface 2110 and the upper peripheral wall 2112, and the second sound chamber 238 can communicate with the first sound chamber 217 through the acoustic holes 215.

The housing 22 can be a shape of hollow cylindrical and includes an upper shell 221 and a lower shell 222. A protruding ring 223 is defined on an inner wall between the upper shell 221 and a lower shell 222 of the housing 22. The upper shell 221 defines an opening 224 on one side. A plurality of through holes 225 are defined on a side wall 2210 of the upper shell 221. In at least one embodiment, the through holes 225 number eight, four of them are arranged in one side of the a first side wall 2210 of the upper shell 221, and four of them are arranged in a second side of the side wall 2210 of the upper shell 221, which making an arrangement mode of the through holes 225 is the same as that of the match holes 214. The lower shell 222 includes a bottom 2220 with an opening 227, and defines an annular receiving space 226 between the bottom 2220 and the protruding ring 223. The bottom 2220 of the lower shell 222 defines a plurality of protruding portions 228. In at least one embodiment, the protruding portions 228 number four, two of them are positioned on a first side of the bottom 2220, and two of them are positioned on a second side of the bottom 2220.

The base unit 40 with a shape of discoid includes a substrate 41 and an edge portion 44 coupled around the substrate 41. The substrate 41 is higher than the edge portion 44, and includes a plurality of protruding columns 42. In at least one embodiment, the protruding columns 42 number four, to follow an arrange mode as two of them are positioned on a first side of the substrate 41, and two of them are positioned on a second side of the substrate 41. The edge portion 44 includes a plurality of receiving holes 43. In at least one embodiment, the receiving holes 43 number four, to follow an arrange mode as two of them are positioned on a first side of the edge portion 44, and two of them are positioned on a second side of the edge portion 44. In assemble, the main body 21 is assembled in the housing 22. The protruding ring 223 is engaged with the groove 213 to enable the housing 22 to rotate relatively to the main body 21. The substrate 41 of the base unit 40 is received in the opening 227 of the housing 22, to make the protruding columns 42 coupled to the corresponding position holes 218 of the main body 21, and the receiving holes 43 are coupled to the corresponding protruding portion 228 of the housing 22. Thereby, the main body 21 and the housing 22 can be fixed on the base unit 40. The cover 10 has a shape of circular ring to detachably couple to the main body 21 and the housing 22, in one side opposite to the base unit 40. In at least one embodiment, the cover 10 is a gasket foam.

In use, when the acoustic unit 30 operates, sound produced by the acoustic unit 30 can be transmitted to outside world from the first sound chamber 217 and the second sound chamber 238. The through holes 225 of the housing 22 can be rotated relatively to the main body 21, to make the through holes 225 overlapped partially or completely with the match holes 214, or non-overlapping with the match holes 214.

When the through holes 225 of the housing 22 are overlapped partially or completely with the match holes 214 of the main body 21 by rotating the housing 22, a plurality of overlap holes 245 are formed from the through holes 225 and the match holes 214. Sound from the acoustic unit 30 can be transmitted to outside world through the first sound chamber 217, the acoustic holes 215, the second sound chamber 238, and the plurality of overlap holes 245.

When the through holes 225 and the match holes 214 are non-overlapping with each other by rotating the housing 22, the sound from the acoustic unit 30 can be transmitted just from the first sound chamber 217, the acoustic holes 215, and the second sound chamber 238.

Therefore, the sound from the acoustic unit 30 can be adjusted in variety, through changing an overlap proportion between the through holes 225 and the match holes 214, which can satisfy people to acquire abundant and various sound effect.

While the disclosure has been described by way of example and in terms of the embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. A speaker device comprising an acoustic tuning assembly, the acoustic tuning assembly comprising:

a main body configured to receive an acoustic unit and comprising:

a first sound chamber; and an upper peripheral wall defining a plurality of match holes; and a housing configured to receive the main body and defining a plurality of through holes;

wherein the housing is capable of being rotated relatively to the main body to make the through holes of the housing overlapped partially or completely with the match holes to form a plurality of overlap holes or make the through holes of the housing non-overlapping with the match holes such that sound from the acoustic unit is transmitted through the first sound chamber and selectively through the overlap holes; and wherein the main body further comprises a first body, a second body, and a groove, the first body comprises a bottom surface coupled to the upper peripheral wall, the bottom surface defines a plurality of acoustic holes connected to the first sound chamber, the groove is formed between the first body and the second body, and is around a periphery of the main body; the housing further comprises a protruding ring defined on an inner wall of the housing, the protruding ring of the housing is engaged with the groove of the main body to enable the housing to rotate relative to the main body.

2. The speaker device according to claim 1, wherein an arrangement mode of the through holes on the housing is the same as that of the match holes on the upper peripheral wall.

3. The speaker device according to claim 1, wherein the first sound chamber is defined in the second body.

4. The speaker device according to claim 3, wherein the second body comprises a lower surface and a lower peripheral wall, the lower peripheral wall extending from an edge of the lower surface and defines a receiving space with the bottom surface of the first body to receive the acoustic unit, the first sound chamber is formed between the bottom surface and a top of the acoustic unit.

5. The speaker device according to claim 4, wherein a second sound chamber is formed between the bottom surface and the upper peripheral wall of the first body, and the second sound chamber communicates with the first sound chamber through the acoustic holes on the bottom surface.

6. The speaker device according to claim 5, wherein the housing comprises an upper shell and a lower shell, the plurality of through holes are defined on the upper shell, the protruding ring is arranged on the inner surface between the upper shell and the lower shell.

7. The speaker device according to claim 6, further comprising a base unit coupled to the acoustic tuning assembly.

8. The speaker device according to claim 7, wherein the base unit comprises a substrate and an edge portion coupled around the substrate, the substrate is higher than the edge portion to be received by an opening of the lower shell and coupled to the lower surface of the second body, the edge portion is coupled to the lower shell of the housing.

9. The speaker device according to claim 8, wherein the lower surface of the second body defines a plurality of position holes, the substrate comprises a plurality of protruding columns, the plurality of protruding columns are coupled to the plurality of position holes to fix the main body on the substrate.

10. The speaker device according to claim 9, wherein the lower shell of the housing comprises a plurality of protruding portions, the edge portion of the base unit defines a plurality of receiving holes, the plurality of protruding portions are coupled to the plurality of receiving holes to fix the housing on the edge portion.

11. The speaker device according to claim 10, further comprising a cover, wherein the cover is detachably coupled to the main body and the housing in one side opposite to the base unit.

12. A speaker device comprising an acoustic tuning assembly, the acoustic tuning assembly comprising:

a main body configured to receive an acoustic unit and comprising an upper peripheral wall defining a plurality of match holes; and a housing configured to receive the main body and defining a plurality of through holes;

wherein the housing is capable of being rotated relatively to the main body to make the through holes of the housing overlapped partially or completely with the match holes, or make the through holes of the housing non-overlapping with the match holes; and wherein the main body further comprises a first body and a second body, and a groove, the first body comprises a bottom surface coupled to the upper peripheral wall, the bottom surface defines a plurality of acoustic holes connected to the first sound chamber, the groove is formed between the first body and the second body, and is around a periphery of the main body; the housing further comprises a protruding ring defined on an inner wall of the housing, the protruding ring of the housing is engaged with the groove of the main body to enable the housing to rotate relative to the main body.

13. The speaker device according to claim 12, wherein the second body comprises a lower surface and a lower circular wall; a first sound chamber is formed between the lower surface, the lower circular wall and the bottom surface; a second sound chamber is formed between the bottom surface and the upper peripheral wall, the acoustic holes is connected to the first sound chamber and the second sound chamber.

14. The speaker device according to claim 13, wherein the housing comprises an upper shell and a lower shell, the plurality of through holes are defined on the upper shell, the protruding ring is arranged on the inner surface between the upper shell and the lower shell.

15. The speaker device according to claim 14, further comprising a base unit coupled to the acoustic tuning assembly, wherein the base unit comprises a substrate and an edge portion coupled around the substrate, the substrate is higher than the edge portion to be received by an opening of the lower shell and coupled to the lower surface of the second body, the edge portion is coupled to the lower shell of the housing.

16. The speaker device according to claim 15, wherein the lower surface of the second body defines a plurality of position holes, the substrate comprises a plurality of protruding columns, the plurality of protruding columns are coupled to the plurality of position holes; the lower shell of the housing comprises a plurality of protruding portions, the edge portion of the base unit defines a plurality of receiving holes, the plurality of protruding portions are coupled to the plurality of receiving holes.

17. The speaker device according to claim 16, wherein when the through holes of the housing are overlapped partially or completely with the match holes of the main body by rotating the housing, a plurality of overlap holes are formed from the through holes and the match holes; sound from the acoustic unit is transmitted to outside world through the first sound chamber, the acoustic holes, the second sound chamber, and the plurality of overlap holes.

18. The speaker device according to claim 17, wherein when the through holes and the match holes are non-overlapping with each other by rotating the housing, the sound from the acoustic unit is transmitted just from the first sound chamber, the acoustic holes, and the second sound chamber.

* * * * *